US010549557B2

(12) United States Patent
Campanini

(10) Patent No.: US 10,549,557 B2
(45) Date of Patent: Feb. 4, 2020

(54) PRINTING APPARATUS AND METHOD

(71) Applicant: CUSTOM S.P.A., Fontevivo (Parma) (IT)

(72) Inventor: Alberto Campanini, Fidenza (IT)

(73) Assignee: CUSTOM S.p.A., Fontevivo (Parma) (IT)

( * ) Notice: Subject to any disclaimer, the term of this patent is extended or adjusted under 35 U.S.C. 154(b) by 0 days.

(21) Appl. No.: 15/567,296

(22) PCT Filed: Apr. 18, 2016

(86) PCT No.: PCT/IB2016/052190
§ 371 (c)(1),
(2) Date: Oct. 17, 2017

(87) PCT Pub. No.: WO2016/170459
PCT Pub. Date: Oct. 27, 2016

(65) Prior Publication Data

US 2018/0111394 A1 Apr. 26, 2018

(30) Foreign Application Priority Data

Apr. 20, 2015 (IT) ..... 102015000012469

(51) Int. Cl.

| | |
|---|---|
| ***B41J 11/26*** | (2006.01) |
| ***B41J 11/66*** | (2006.01) |
| ***B26D 5/20*** | (2006.01) |
| ***B41J 11/70*** | (2006.01) |
| *B26D 1/00* | (2006.01) |
| *B26D 7/00* | (2006.01) |

(52) U.S. Cl.
CPC ..... *B41J 11/663* (2013.01); *B26D 5/20* (2013.01); *B41J 11/703* (2013.01); *B26D 2001/0066* (2013.01); *B26D 2007/005* (2013.01)

(58) Field of Classification Search
CPC ..... B41J 11/70
USPC ..... 226/46; 400/621
See application file for complete search history.

(56) References Cited

U.S. PATENT DOCUMENTS 5,223,940 A 6/1993 Matsumoto
2012/0018484 A1* 1/2012 Yano ..... B41J 15/042 226/46

(Continued)

FOREIGN PATENT DOCUMENTS

CN 102142156 A 8/2011
EP 2000315 A1 12/2008

(Continued)

OTHER PUBLICATIONS

Italian Search Report & Written Opinion Application No. I055143/ITUB20150508 Completed Date: Dec. 10, 2015 7 Pages.

(Continued)

*Primary Examiner* — Lam S Nguyen
(74) *Attorney, Agent, or Firm* — Whitmyer IP Group LLC

(57) ABSTRACT

A printing method and apparatus are disclosed, in which a printed document is separated from a continuous strip of paper by a cutting device having a movable blade that can adopt a rest position, in which the blade is retracted to leave free a passage for inserting the strip in a cutting zone, and at least one cutting position, in which the blade is advanced to obstruct the passage, with sensor means that is able to indicate when the blade is in the two positions.

22 Claims, 7 Drawing Sheets

(56) References Cited

U.S. PATENT DOCUMENTS

| | | | | |
|---|---|---|---|---|
| 2012/0053730 | A1 | 3/2012 | Nagatsu | |
| 2015/0258819 | A1* | 9/2015 | Chiba | B41J 11/663 83/13 |

FOREIGN PATENT DOCUMENTS

| | | | |
|---|---|---|---|
| EP | 2749427 | A2 | 7/2014 |
| JP | H04142957 | A | 5/1992 |
| JP | 2000194889 | A | 7/2000 |
| JP | 2012245599 | A | 12/2012 |
| WO | 2010137252 | A1 | 12/2010 |

OTHER PUBLICATIONS

PCT International Search Report and Written Opinion Application No. PCT/IB2016/052190 Completed Date: Jun. 29, 2016; dated Jul. 18, 2016 15 Pages.

Chinese Office Action Application No. 201680022788.3 Completed: Feb. 3, 2019 11 Pages.

* cited by examiner

PRINTING APPARATUS AND METHOD

TECHNICAL FIELD

The invention relates to a printing method and apparatus, in particular in which there is a strip from which the printed documents are separated in succession one after the other by means of a driven cutting device.

BACKGROUND

Specifically, but not exclusively, the invention can be applied to dispense in a short time a great number of printed documents (for example tickets, receipts, slips, coupons, vouchers, etc.) printed on a strip and then separated from the strip, in particular for lottery or betting terminals.

The known art comprises various printing apparatuses provided with a driven cutting device that separates the printed documents from a continuous strip.

It is desirable to improve the dispensing speed of known printing apparatuses, in particular for lottery or betting terminals, in which a great number of documents sometimes has to be printed rapidly.

SUMMARY

One object of the invention is to make a printing apparatus for dispensing in succession a plurality of printed documents by separating the printed documents from a strip by means of a driven cutting device.

One object of the invention is a printing method for dispensing in succession a plurality of printed documents by separating the printed documents from a strip.

One advantage is to dispense in a relatively short time a great number of documents that are printed and separated one by one from a strip.

One advantage is to form stacks of printed documents (tickets, receipts, slips, coupons, vouchers, etc.) at a high speed.

One advantage is providing a printing apparatus that is constructionally simple and cheap for dispensing single printed documents.

Such objects and advantages and still others are achieved by the apparatus and by the method according to one or more of the claims set out below.

In one embodiment, a printing apparatus comprises: a path of a strip as far as a cutting zone, a print head arranged along said path for printing a document on the strip, a blade arranged in said cutting zone for separating the printed document from the strip, detecting means arranged for emitting a signal when the blade, after separating the document from the strip, is in a position in which it obstructs said path. The apparatus may further comprise an actuator that is driven in response to said signal just before said blade returns to a position in which, leaving said path free, enables the strip to advance for the next document, so as to anticipate the driving of the actuator to appropriately accelerate dispensing in series of several printed documents.

This actuator may comprise a device for moving the strip and/or the document. This actuator may comprise a stacking device arranged for moving the document from a cutting zone to a stacking zone. This actuator may comprise a retrograde conveying device suitable for moving back the strip from a cutting zone to a zone for the start of printing a new document. This actuator may comprise an advancement device arranged for sending the document to a document removal outlet. The stacking device and/or the retrograde conveying device and/or the advancement device can be, in this manner, activated in advance, before the cutting device returns to the non-occluded position, in other words without waiting for the cutting cycle end position (with retracted blade), such as to accelerate operations for subsequent printing.

BRIEF DESCRIPTION OF THE DRAWINGS

The invention can be better understood and implemented with reference to the enclosed drawings that illustrate some embodiments thereof by way of non-limiting examples.

DETAILED DESCRIPTION

Figure 2:
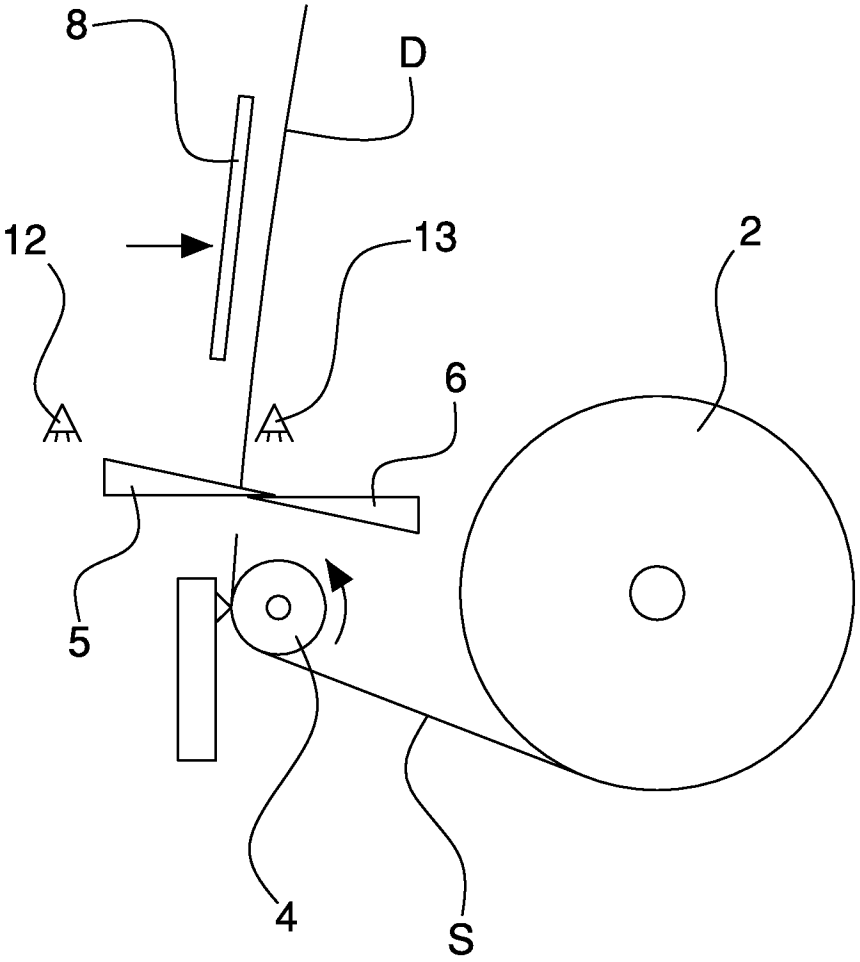
FIG. 2 shows the diagram of FIG. 1 with the cutting device in a cutting position.

In the aforesaid figures, identical elements of the various embodiments have been indicated, for the sake of simplicity, by the same numbering.

With reference to the aforesaid figures, with 1 there is indicated overall a printing apparatus, which is usable in particular for printing tickets, receipts, slips, vouchers, coupons, or other types of printed documents in real time. The printing apparatus 1 may be used, in particular, in a lottery or betting terminal.

The printing apparatus 1 may comprise, in particular, a magazine for housing printing paper or types of printing supports. The printing support that is usable by the printing apparatus 1 in question may be, in particular, paper, for example thermal paper. In this patent text, "paper" is defined as any printing support that is suitable for printing (in particular with a thermal print head or inkjet), for example a material that is printable in the form of a strip, in particular wound on a reel, like a reel of (thermal) paper. In this patent text "strip" is defined not only as a strip of paper unwound from a reel, but also other types of printing supports (of known type) like for example, a set of sheets in continuous fan-fold format, or a set of sheets (for example labels) arranged in a row in the shape of a strip, etc.

In the specific case the magazine may comprise, in particular, at least one seat set up for receiving at least one reel 2 of (thermal) paper. The magazine may nevertheless comprise other examples of paper magazines (also of known type).

The printing apparatus 1 may comprise, for example, a containing body, or casing, (for example box-shaped) suitable for containing the various components of the printing apparatus or at least a part thereof.

The printing apparatus 1 may comprise, in particular, a path for supplying a continuous strip S of paper coming from the magazine (in this case a strip S unwound from the reel 2) to a cutting zone of the printed document D.

The printing apparatus 1 may comprise, in particular, a printing device for printing a document on the strip of paper that is advancing (unwound from the reel 2). The printing device may comprise, for example, a print head 3 (of thermal, inkjet or other type) arranged along the path of the strip S of paper to print on at least a first face of the paper (for example a thermally sensitive face). In the specific case a thermal print head 3 is arranged, but it is possible to envisage the use of a printing device of inkjet or yet other type.

A printing roller 4 (paper dragging roller) opposite the print head 3 may be operationally associated with the print head 3. The printing roller 4 may operate in contact with a second face of the paper (opposite the first printable side). The path of the strip S of paper passes, in particular, between the print head 3 and the printing roller 4. The printing roller 4 may be controlled (by a programmable electronic controller, which is not illustrated) in cooperation with the print head 3, to advance the strip S in a coordinated manner during the document D printing step.

The printing roller 4 may be driven in a reversible manner. In particular the printing roller 4 may be driven with a retrograde rotation (FIG. 2) to move back the strip S, after cutting of a document D, in a position that is suitable for starting printing of the subsequent document.

Figure 5:
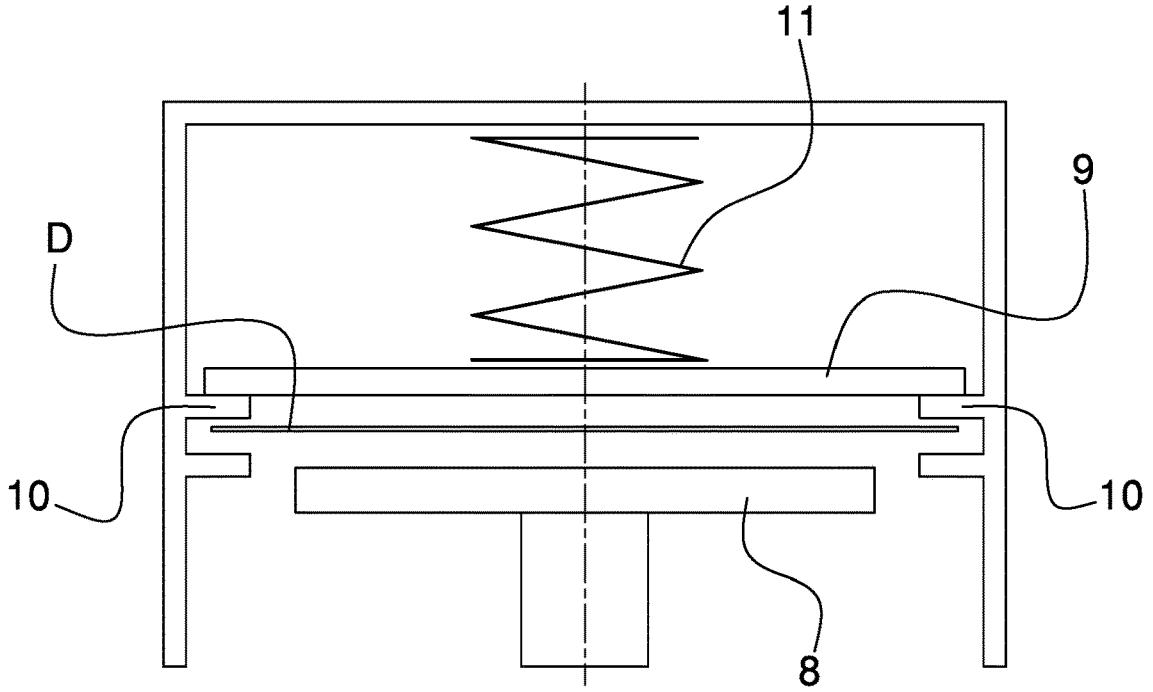
FIG. 5 is a diagram of the stacking device of the printing apparatus in FIG. 3 in a rest position.
Figure 6:
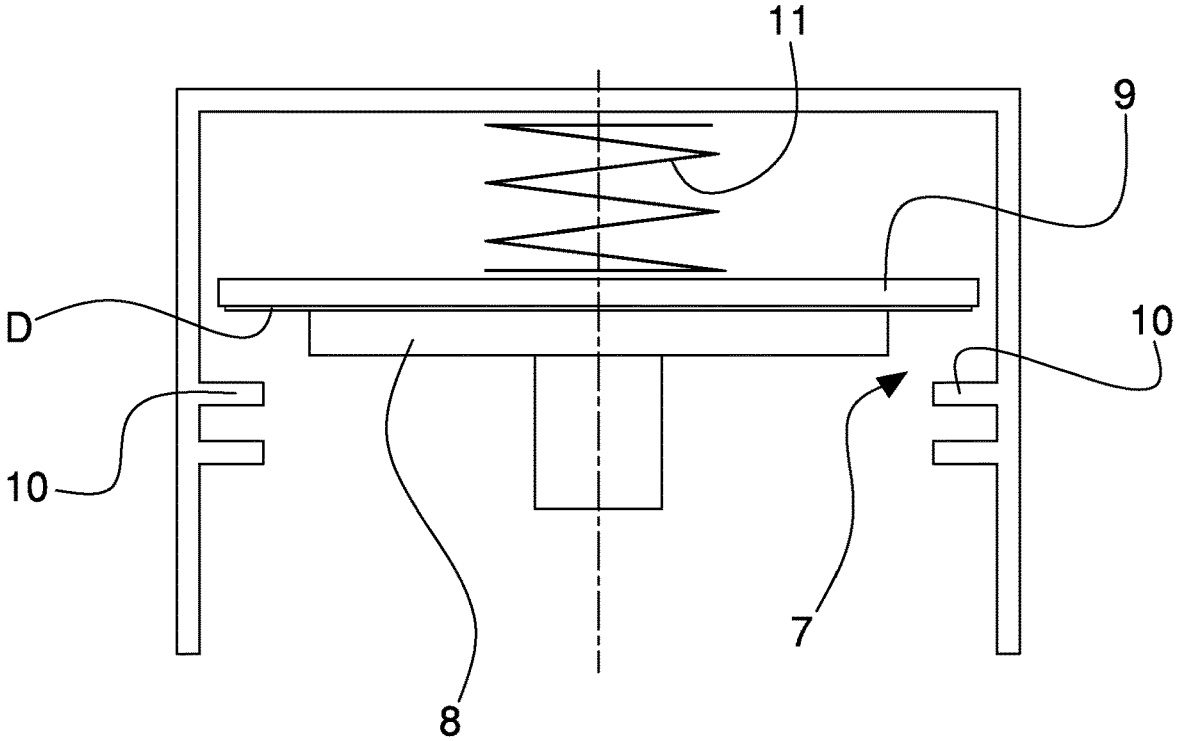
FIG. 6 shows the diagram of FIG. 5 in a work position.

The printing apparatus 1 may comprise, in particular, a cutting device for separating the printed document D from the rest of the strip S when the document D is (stationary) in a cutting zone (FIG. 2 or FIG. 5). The cutting device may comprise, for example, a driven movable blade 5 cooperating with a stationary blade 6.

Figure 1:
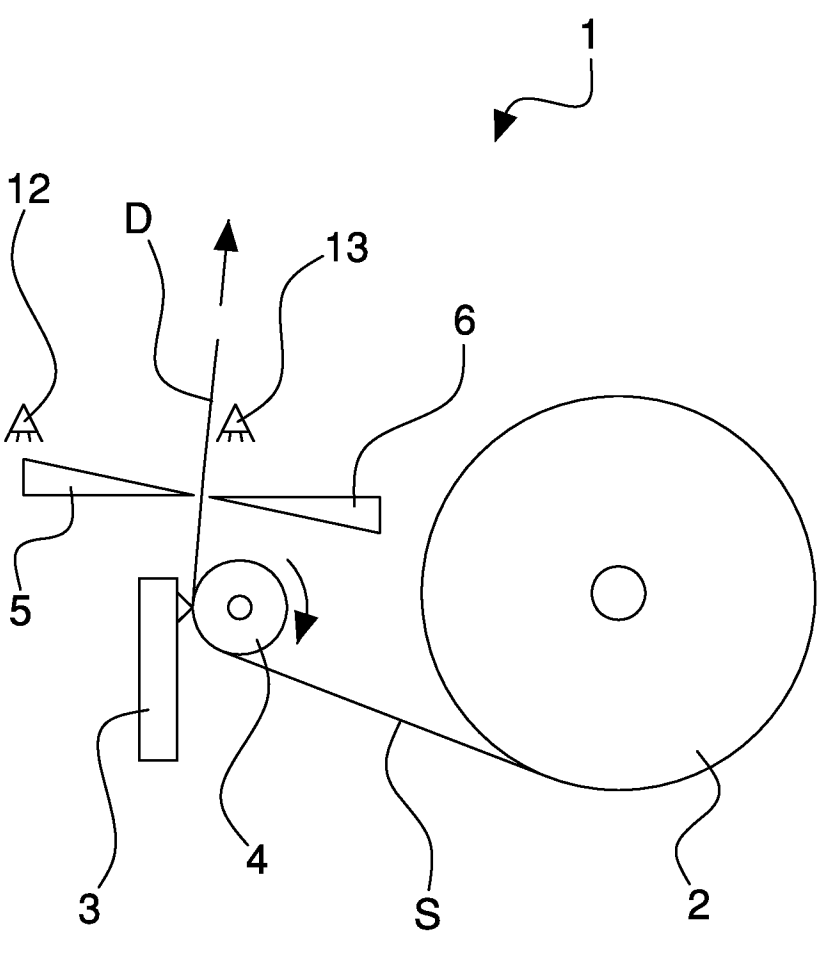
FIG. 1 is a diagram of a first embodiment of a printing apparatus, made according to the invention, during printing of a document with the cutting device in a rest position.
Figure 3:
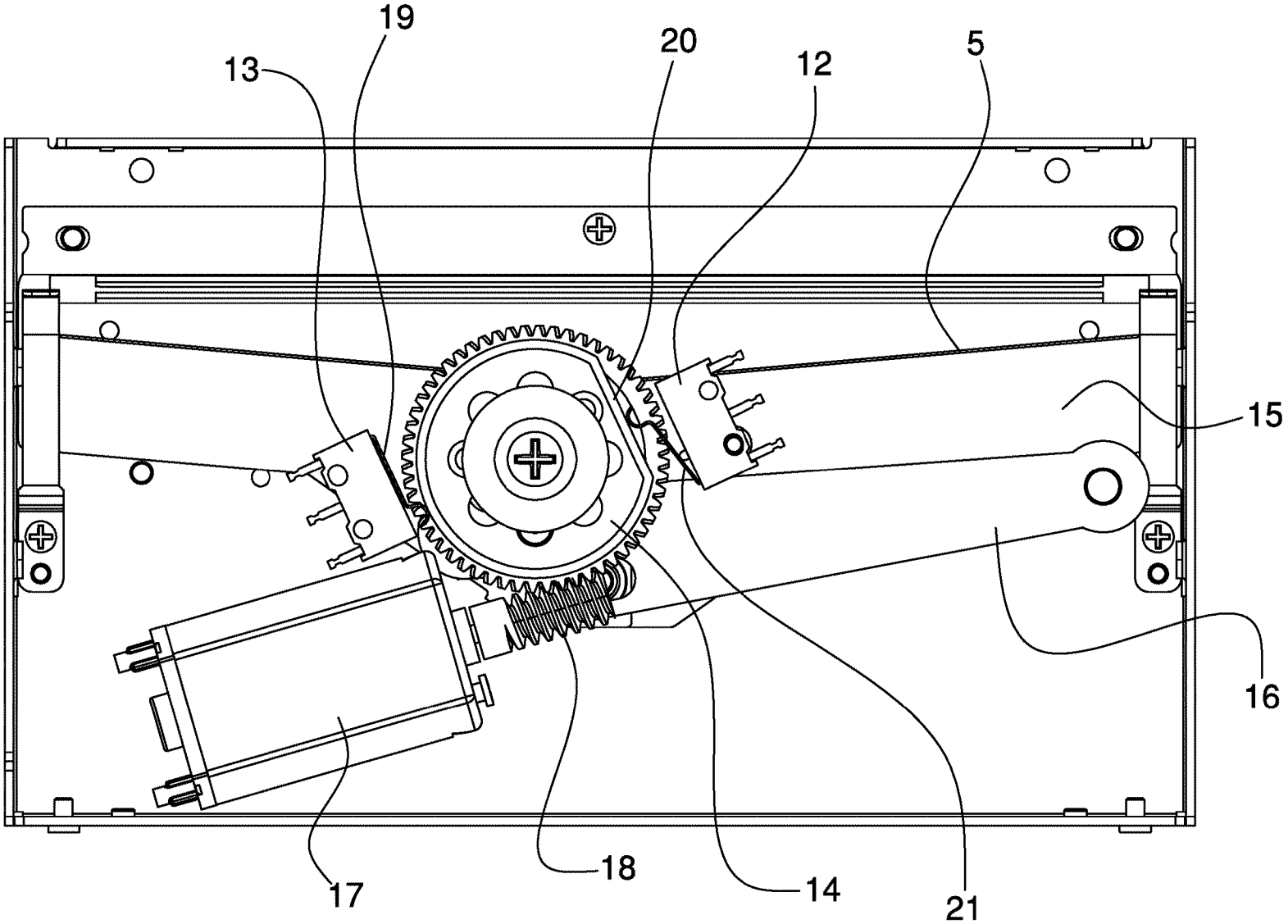
FIG. 3 shows a detail of a second embodiment of an apparatus according to the invention with the cutting device in a rest position.
Figure 4:
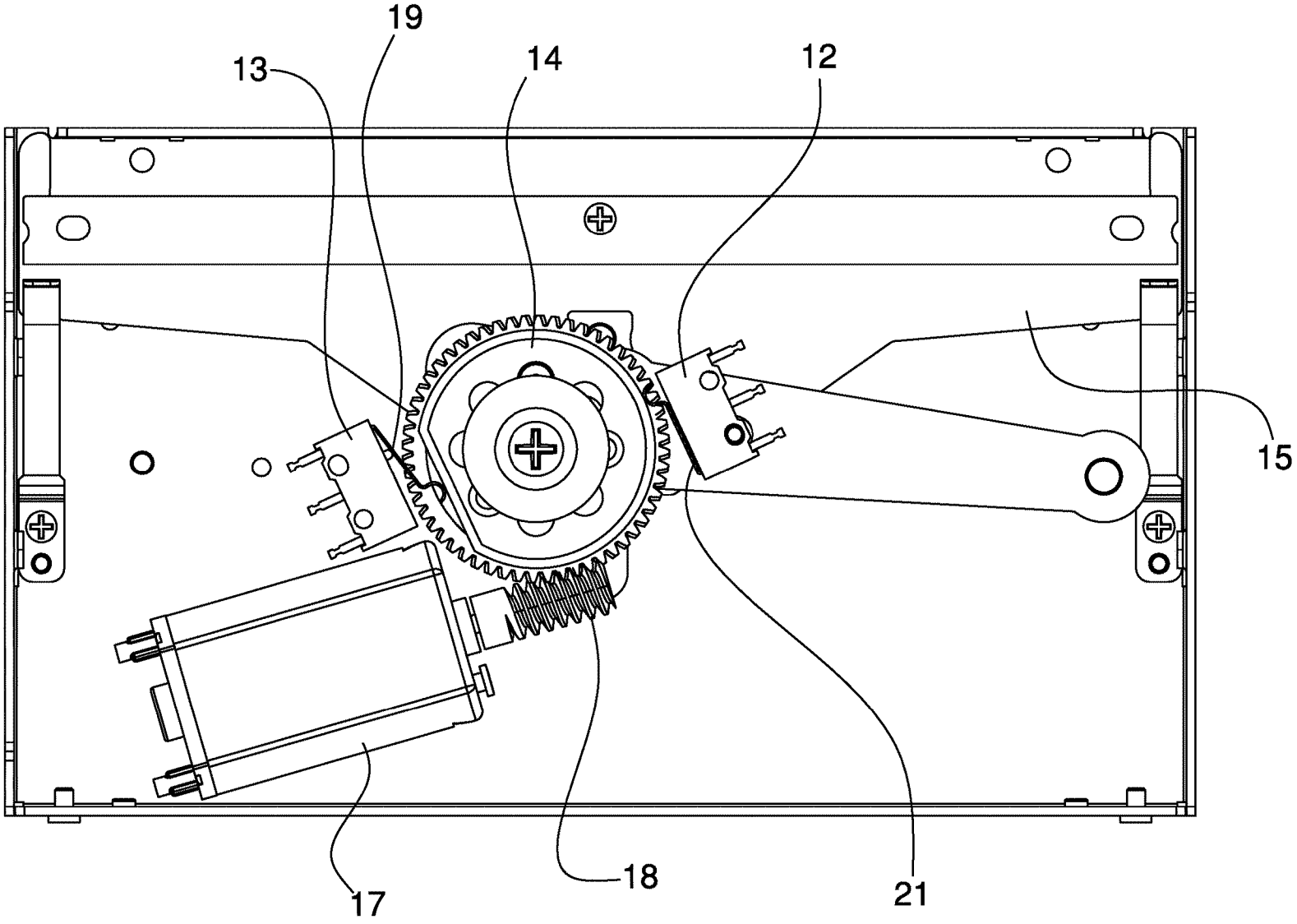
FIG. 4 shows the device in FIG. 3 with the cutting device in a cutting position.

The cutting device may be arranged for adopting at least one first configuration (rest configuration, FIG. 1 or FIG. 3) and at least one second configuration (cutting or work configuration, FIG. 2 or FIG. 4). In the first configuration (FIGS. 1 and 3) the movable blade 5 is retracted and far from the stationary blade 6, leaving free (between the blade 5 and the blade 6) a space for the passage of the printed document D to the cutting zone where the printed document D stops to be separated from the rest of the strip S. In the second configuration (FIGS. 2 and 4) the movable blade 5 is advanced and partially superimposed on the stationary blade 6, obstructing the aforesaid space (between the blade 5 and the blade 6).

The printing apparatus 1 may comprise, in particular, a movement device for moving the document D (already separated from the rest of the strip S). The document D may be moved, in particular, from the cutting zone (FIG. 5) to a stacking zone 7 in which two or more printed documents D can be stacked on one another to be easily grasped and/or handled by a user.

The movement device may comprise, in particular, at least one (driven) member 8 that moves the document D, at least one movable stacking wall 9 arranged in the stacking zone 7 to maintain the document D situated in the stacking zone 7 pressed against abutting means 10. The wall 9 may be provided with elastic means (for example at least one coil spring 11 arranged between the wall 9 and the case of the apparatus) that pushes the wall 9 against the abutting means 10.

The printing apparatus 1 may comprise, in particular, first sensor means 12 arranged for signalling when the cutting device is in the first (rest) configuration. The printing apparatus 1 may comprise, in particular, second sensor means 13 arranged for signalling when the cutting device is in the second (cutting) configuration.

The first sensor means 12 may comprise, as in this embodiment, a first switch that opens or closes when the cutting device is in the second configuration. The second sensor means 13 may comprise, as in this embodiment, a second switch that opens or closes when the cutting device is in the second configuration.

The second sensor means 13 may be arranged, in particular, for emitting a signal (for example an electric switch closed or open signal) after the cutting device has separated a document D from the rest of the strip S and before the cutting device returns to a configuration (for example the first rest configuration) that is suitable for enabling the strip S to advance to print a new document D through the space between the blades 5 and 6.

The first sensor means 12 may be arranged, in particular, for emitting a signal (for example an electric switch closed or open signal) at the moment in which the cutting device, after separating a document D from the rest of the strip S, has returned to a configuration (for example the first rest configuration) that is suitable for enabling the strip S to advance to print a new document D.

As in the embodiment disclosed here, the cutting device may comprise a first element 14 with rotary motion and a second element 15 with reciprocal motion that receives the motion from the first element 14. The second element 15 carries the movable blade 5. The first element 14 may be connected to the second element 15 through a mechanism transforming rotary motion into reciprocal motion, for example a crank and slotted link mechanism with a rocker 16 (as in this embodiment), of the connecting rod and handle type, or of yet another type.

The cutting device may comprise, as in this embodiment, an (electric) motor 17 having a rotor connected (coaxially) to a worm screw 18 connected mechanically to the first rotating element 14.

The first sensor means 12 may be operationally associated with the first element 14 (as in this embodiment) and/or with the second element 15 and/or directly with the movable blade 5. The second sensor means 13 may be operationally associated with the first element 14 (as in this embodiment) and/or with the second element 15 and/or directly with the movable blade 5. In particular, the second sensor means 13 may comprise an elastic element 19 (for example in the shape of an arm) engaged with a cam profile 20 arranged on the first element 14. The elastic element 19 may act, as in this case, on a pushbutton of an electric contact. In particular, the first sensor means 12 may comprise, for example, an elastic element 21 (for example in the shape of an arm) engaged with the cam profile 20 of the first element 14.

In the specific embodiment, the second sensor means 13 (as with the first sensor means 12) comprises at least one presence or proximity sensor (a switch). In the specific embodiment, the second sensor means 13 (as with the first sensor means 12) comprises at least one sensor of mechanical type (a switch). It is nevertheless possible to use other types of sensor, for example at least one sensor of optical type, of magnetic type, of ultrasound type, etc, that is able to detect when the cutting device is in the second cutting configuration (or in the first rest configuration in the case of the first sensor means 12).

The printing apparatus 1 may comprise at least one operations actuator that is able to perform one or more operations at the command of (programmable electronic) control means. The operations actuator may comprise, in particular, a device for moving the strip S and/or the document D. The aforesaid control means may be arranged, in particular, for driving the actuator in response to a signal sent by the second sensor means 13. The aforesaid control means may be arranged, in particular, to start printing of a document, by driving the printing device (with the roller 4 that makes the strip S advance), in response to a signal sent by the first sensor means 12.

The aforesaid actuator may comprise, as in this case, the aforesaid movement device (in particular the driving motor driving the thrust member 8) that is suitable for moving the printed document D from the cutting zone, where the cutting device had separated the document D from the strip S, to the stacking zone 7 where the printed documents D can be stacked on one another in an orderly manner.

In this embodiment, when the movable blade 5 is in an advanced cutting position, the second sensor means 13 emits a signal indicating the fact that the cutting device has reached the second (cutting or work) configuration. This signal is sent to the control means, which activates the movement device (thrust member 8) for moving the printed document D to the stacking zone 7.

The aforesaid actuator may comprise, as in this embodiment, a conveying device arranged for retracting the strip S, which has just been separated from the printed document D, to a zone for the start of printing a new document. This conveying device may comprise, in particular, the printing roller 4, which is provided with reversible motion and is thus able to retract the strip (see arrow F of FIG. 2).

The aforesaid actuator may comprise, as said, an advancement device (for example of the roller type) for sending the document, for example, to a removing or dispensing zone where a user can withdraw the document.

The printing apparatus 1 may comprise, in particular, the aforesaid control means (programmable electronic controller), comprising for example at least one electronic card connected to sensors and actuators of the printing apparatus.

The control means operates in such a manner as to perform the following operations. The printing apparatus 1 prints a document D on the strip. The printed document arrives in the cutting zone. The cutting device separates the document D (located in the cutting zone) from the rest of the strip S. The second sensor means 13 indicates to the control means that the document D has been separated, when the cutting device is still in the configuration (advanced blade 5) of occluding the advancement path of the strip S. In this situation (before the path of the strip S is again freed from the cutting device), the movement device (thrust member 8) starts to move the document D to the stacking zone 7 and/or the conveying device (printing roller 4) starts to return the strip back to the start position of a new print.

In this manner it is possible to anticipate, by a few tenths of a second, the start of the operations for printing the subsequent document, with respect to the moment in which the path of the strip is again free.

In addition to the movement device and/or to conveying device and/or to the advancement device, it is possible to provide other operations actuators that can be activated in advance in the aforesaid situation in which the path of the strip S is still occupied by the cutting device.

The printing apparatus 1 may comprise, in particular, program instructions that are implementable in this programmable controller to perform the following steps of a printing method: printing a document on a strip that is advancing; separating the document from the strip by means of a cutting device; detecting when the cutting device is in a configuration in which, after separating the document, the cutting device obstructs a path along which the strip has to advance to print a new document; driving an actuator in response to the aforesaid detection, in particular to start operations early for printing the subsequent document, compared with the moment in which the path of the strip is again free.

Figure 7:
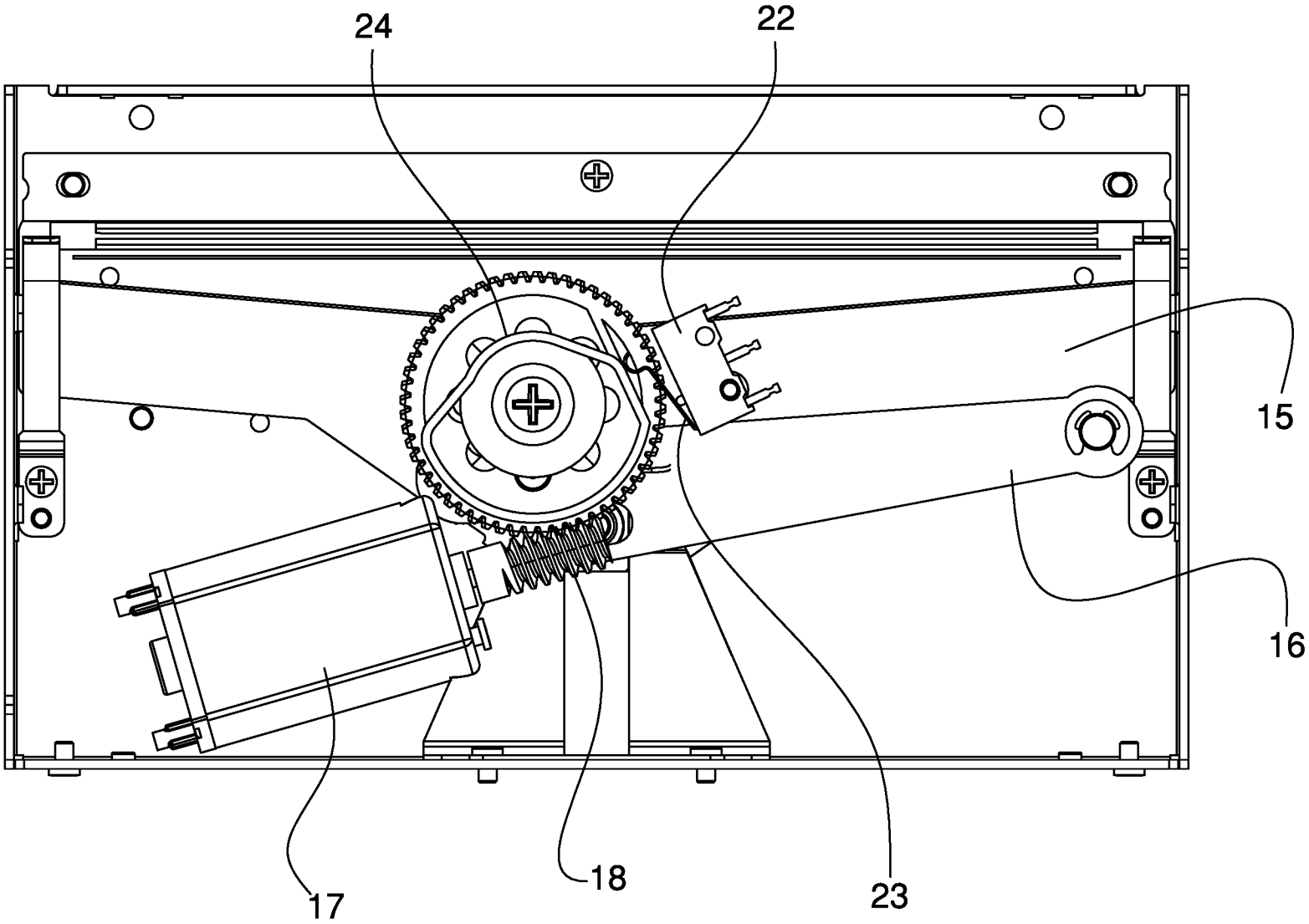
FIG. 7 shows a detail of a third embodiment of an apparatus according to the invention with the cutting device in a rest position.

With reference to FIG. 7, an embodiment of the invention is illustrated in which the sensor means that detects the two configurations (paper path free and paper path occupied) of the cutting device comprises a single (presence or proximity, in particular un switch) sensor 22. The sensor 22 may comprise an elastic element 23 (for example in the shape of an arm) engaged with a shaped portion of the first element 14, for example a cam profile 24 arranged on the first element 14. The cam profile 24 may be shaped, as in this embodiment, in such a manner as to induce a transition in the sensor 22 when the cutting device arrives at the first rest configuration (paper path free) and when it arrives at the second cutting configuration (paper path occupied). This transition may comprise, in particular, a change of the switch from ON to OFF or, vice versa, from OFF to ON. The cam profile 24 may have, in particular, a first (greater) diameter for a zone of the profile of an angular size that about half a revolution greater and a second diameter (lesser than the first) for the remaining angular size of half a revolution.

The operation of the embodiment in FIG. 7 is clear from what has been disclosed previously. When the cutting device arrives in the cutting configuration (with the advanced blade 5 that occupies the paper passage), the sensor 22 has a transition that is used as a signal to the control means to activate the operations actuator without having to wait for the blade 5 to return to the retracted rest position.

Figure 8:
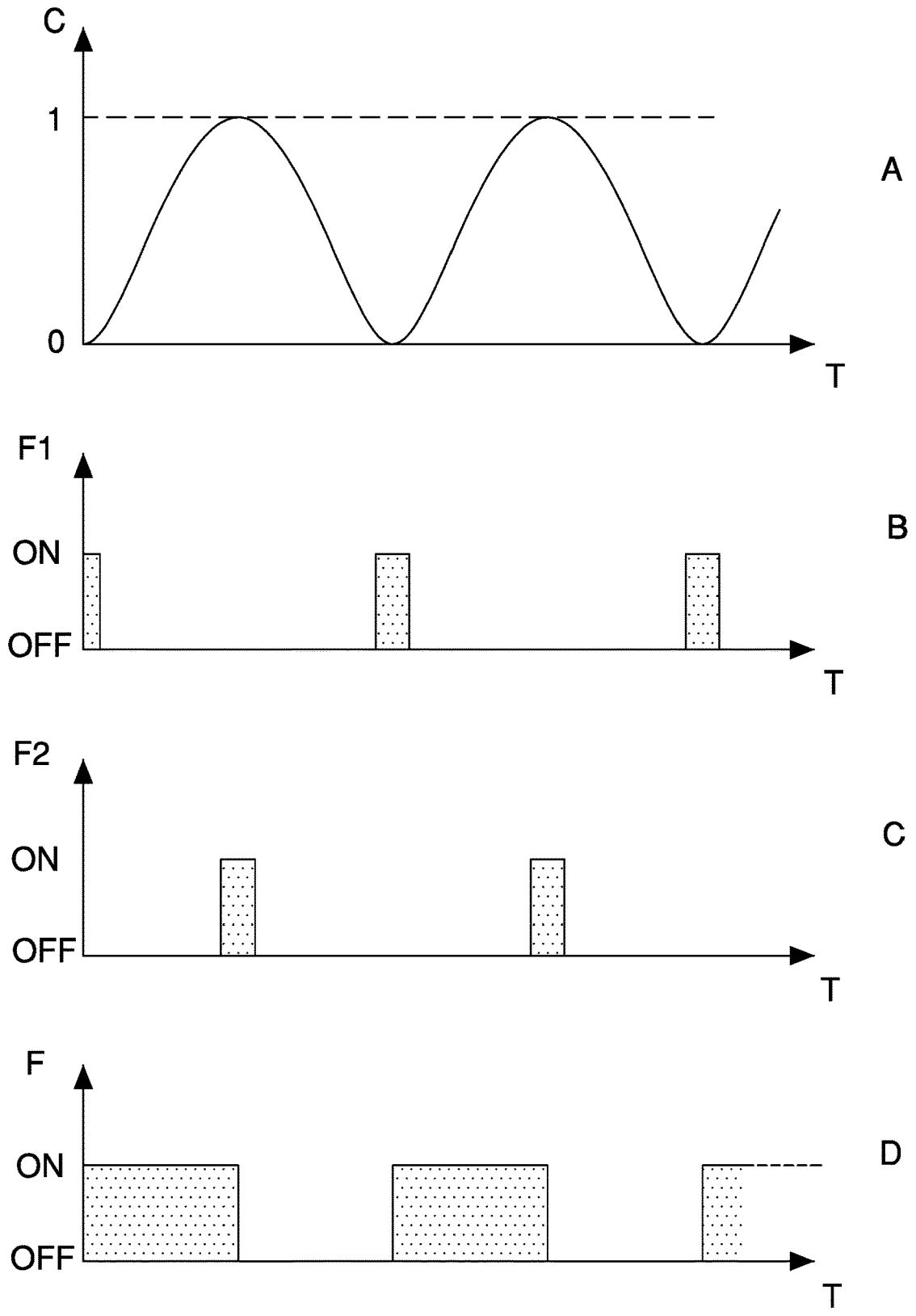
FIG. 8 shows, schematically, one embodiment of the operation of the printing apparatus, with the following diagrams as a function of the time T: a diagram A of the movement C of the blade of the cutting device, a diagram B of the signal S1 of the first sensor (switch) of the embodiment in FIG. 3, a diagram C of the signal S2 of the second sensor (switch) of the embodiment in FIG. 3, a diagram D of the signal S of the single sensor (switch) of the embodiment in FIG. 7.

In FIG. 8, the diagram A shows the schematic curve of the movement C of the blade 5 of the cutting device in function of the time T. The blade 5 is in position "0" when it is retracted in the first (rest) configuration in which it does not occupy the path of the paper. The blade 5 is in position "1" when it is advanced in the second configuration (about half way through the complete cutting cycle) in which it occupies the path of the paper and has to return to position "0" to separate a new document.

In FIG. 8, diagram B shows the status F1 of the first sensor means 12 of the embodiment in FIGS. 3 and 4, which detects when the cutting device is in the first configuration (rest configuration of the device, with the paper path free). The status F1 of the sensor is ON when the blade 5 is in position "0" or is near or around this position. The status F1 of the sensor is OFF when the blade 5 is far from position "0", in particular when it is in position "1". In FIG. 8, diagram C shows the status F2 of the second sensor means 13 of the embodiment in FIGS. 3 and 4, which detects when the cutting device is in the second configuration (half way through the cutting cycle, with the paper path occupied). The status F2 of the sensor is ON when the blade 5 is in position "1" or is near or around this position. The status F2 of the sensor is OFF when the blade 5 is far from position "1", in particular when it is in position "0".

In FIG. 8, diagram D shows the status F of the sensor 22 of the embodiment in FIG. 7. At or near positions "0" and "1" of the blade 5 of the cutting device, the status F of the sensor 22 has a transition (change from ON to OFF and vice versa) indicating the fact that the cutting device has arrived at the first (rest) configuration or at the second configuration (about half way through the cycle).

Figure 9:
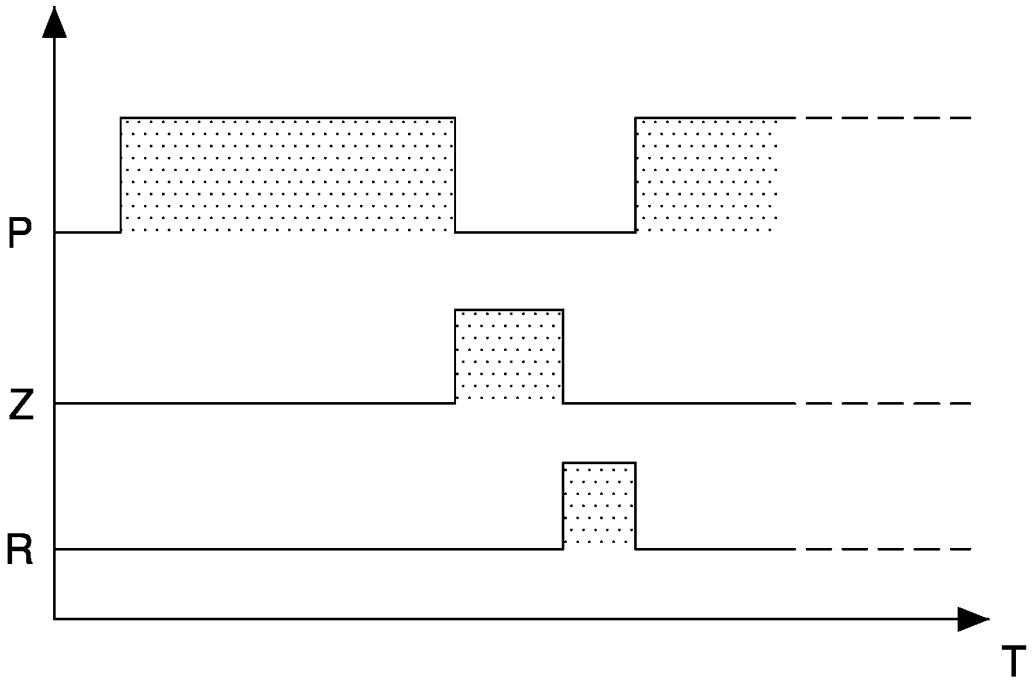
FIG. 9 shows schematically the steps of activating the printing device (curve P), of the cutting device (curve C) and of a further actuator (curve R), in function of the time T, in a printing apparatus of the known art.
Figure 10:
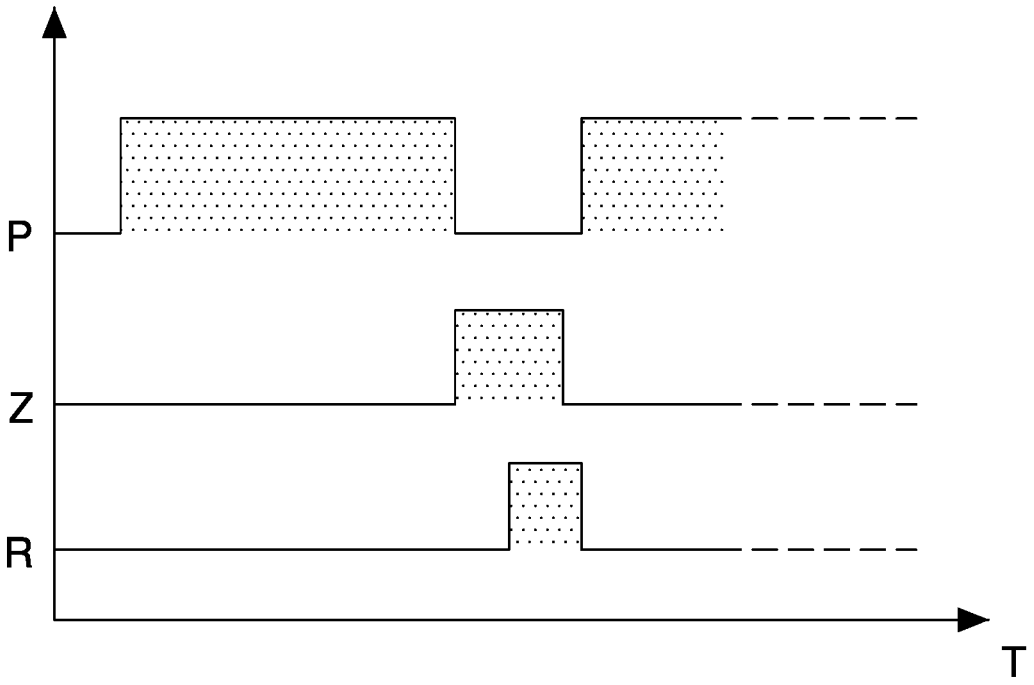
FIG. 10 shows, by way of comparison, the same steps of activating of the diagram of FIG. 9 for a printing apparatus according to the invention.

The printing apparatus according to the invention basically enables printing productivity to be increased, especially when several documents in sequence have to be dispensed, one immediately after the other, as can be seen by comparing the operation diagrams shown in FIGS. 9 and 10.

The graph in FIG. 9 (relating to a printing apparatus di known type) shows schematically the steps of operation, in sequence, of the devices of the printing apparatus. In particular, with P the graph is indicated indicating the steps of operation of the printing device (with printing steps alternating with rest steps), with Z the steps of operation of the cutting device (with cutting steps alternating with rest steps), with R the steps of operation of an operations actuator, for example to retract paper to recover the start of the new document to be printed and/or to stack the document and/or to dispense the document to the outlet, etc (with work steps alternating with rest steps). It is observed that the cutting device is activated, substantially, at the end of the printing step; the operations actuator is activated, substantially, at the end of the cutting step; the new printing step starts, substantially, at the end of the work step of the operations actuator.

In the graph of FIG. 10 (relating to a printing apparatus according to the invention) the steps of operation P, Z and R are indicated (P=printing; Z=cutting; R=recovering, stacking, dispensing, etc.), analogously with FIG. 9. It is observed that, in this case, the operations actuator is activated during the cutting step (about half way through the cutting step, but before the end of the cutting cycle that includes the forward and backward stroke of the blade 5), thereby the new printing step can start earlier (for example by a few tenths of a second) than the graph in FIG. 9.

In one embodiment that is not shown, the sensor means for detecting the occupied path situation may comprise timer means arranged for determining the moment in which the cutting device is half way through the cutting cycle or around half way through the cutting cycle. This timer means may comprise, for example, a timed relay that is able to be energized with a set delay with respect to the instant at which the cutting cycle starts. This timer means may comprise, in particular, means (for example of the software type) for determining the length of the complete cutting cycle, to calculate a fraction of this time (for example about half) and for emitting a signal at the instant in which the cutting cycle has arrived at the calculated fraction. This timer means may comprise, in particular, program instructions that are implementable in the programmable electronic control means to execute a method of operation of the printing apparatus as disclosed above.

The invention claimed is:

1. A printing apparatus comprising:

a printing device arranged for printing a document on a strip that advances along a path;

a cutting device which is arranged for separating the document from the strip and which can adopt at least one first configuration, in which it does not occupy said path, and at least one second configuration, in which it occupies said path;

a sensor means arranged for detecting a free path situation, when said cutting device is in said first configuration, and an occupied path situation, when said cutting device is in said second configuration;

an at least one actuator arranged for moving the document separated from the strip;

a control means arranged for driving said actuator to move the document in response to a signal emitted by said sensor means when said cutting device, after separating the document from the strip, is in said second configuration, so as to anticipate the driving of the actuator before said cutting device returns to said first configuration to accelerate printing in series of several documents.

2. The printing apparatus according to claim 1, wherein said actuator includes a movement device for moving the document from a cutting zone, where said cutting device separates the document from the strip, to a stacking zone where the printed documents are stacked.

3. The printing apparatus according to claim 2, wherein said actuator includes an advancement device for sending the document to an outlet.

4. The printing apparatus according to claim 2, said apparatus including:

a printing device arranged for printing a document on a strip that advances along a path;

a cutting device which is arranged for separating the document from the strip and which can adopt at least one first configuration, in which it does not occupy said path, and at least one second configuration, in which it occupies said path;

sensor means arranged for detecting a free path situation, when said cutting device is in said first configuration, and an occupied path situation, when said cutting device is in said second configuration, in which said sensor means includes a switch that opens or closes when said cutting device is in said second configuration;

at least once actuator arranged for moving the strip and/or the document;

control mean arranged for driving said actuator in response to said occupied path signal.

5. The printing apparatus according to claim 2, said apparatus including:

a printing device arranged for printing a document on a strip that advances along a path;

a cutting device which is arranged for separating the document from the strip and which can adopt at least one first configuration, in which it does not occupy said path, and at least one second configuration, in which it occupies said path;

sensor means arranged for detecting a free path situation, when said cutting device is in said first configuration, and an occupied path situation, when said cutting device is in said second configuration.

6. The printing apparatus according the claim 2, wherein sensor means includes a first sensor means arranged for signaling when said cutting device is in said first configuration.

7. The printing apparatus according to claim 2, wherein said sensor means includes a second sensor means arranged for signaling when said cutting device is in said second configuration.

8. The printing apparatus according to claim 1, wherein said actuator includes an advancement device for sending the document to an outlet.

9. The printing apparatus, according to claim 1, said apparatus including:

a printing device arranged for printing a document on a strip that advances along a path;

a cutting device which is arranged for separating the document from the strip and which can adopt at least one first configuration, in which it does not occupy said path, and at least one second configuration, in which it occupies said path;

sensor means arranged for detecting a free path situation, when said cutting device is in said first configuration, and an occupied path situation, when said cutting device is in said second configuration, in which said sensor means includes a switch that opens or closes when said cutting device is in said second configuration;

at least one actuator arranged for moving the strip and/or the document;

control means arranged for driving said actuator in response to said occupied path signal.

10. The printing apparatus, according to claim 1, said apparatus including:

a printing device arranged for printing a document on a strip that advances along a path;

a cutting device which is arranged for separating the document from the strip and which can adopt at least one first configuration, in which it does not occupy said path, and at least one second configuration, in which it occupies said path;

sensor means arranged for detecting a free path situation, when said cutting device is in said first configuration, and an occupied path situation, when said cutting device is in said second configuration.

11. The printing apparatus according to claim 1, wherein said sensor means includes a first sensor means arranged for signaling when said cutting device is in said first configuration.

12. The printing apparatus according to claim 1, wherein said sensor means includes a second sensor means arranged for signaling when said cutting device is in said second configuration.

13. The printing apparatus according to claim 1, wherein said sensor means includes a presence or proximity sensor means that interacts with a rotating shaped portion of said cutting device.

14. The printing apparatus according to claim 1, including at least one actuator, in particular one actuator arranged for moving the strip and/or the document, and control means arranged for driving said actuator in response to said occupied path signal.

15. The printing apparatus according to claim 14, wherein said actuator includes: a movement device for moving the document from a cutting zone, where said cutting device separates the document from the strip, to a stacking zone where the printed documents are stacked; and/or a conveying device for moving back the strip that has just been separated from the document to a zone for the start of printing a new document; and/or an advancement device for sending the document to an outlet.

16. The printing apparatus according to claim 1, wherein said sensor means includes a switch that opens or closes when said cutting device is in said second configuration.

17. The printing apparatus according to claim 1, wherein said sensor means includes a presence or proximity sensor means that interacts with a portion of said cutting device for detecting a situation in which said cutting device, after separating a document from the strip, has not yet returned to said first configuration that is suitable for enabling the strip to advance to print a new document.

18. The printing apparatus according to claim 1, wherein said cutting device includes a first element with rotary motion and a second element with reciprocal motion that receives the motion from said first element, said second element carrying a cutting blade, said sensor means being operationally associated with said first element and/or said second element.

19. The printing apparatus according to claim 1, wherein said sensor means includes a timer means arranged for determining when said cutting device is in said second configuration.

20. A printing method, in particular that uses an apparatus according to claim 1, said method including the steps of:

printing a document on a strip that is advancing;

separating the document from the strip by means of a cutting device;

detecting when said cutting device is in a configuration in which, after separating the document, it occupies a path along which the strip has to advance to print a new document;

driving an actuator in response to said detection.

21. A printing apparatus comprising:

a printing device arranged for printing a document on a strip that advances along a path;

a cutting device which is arranged for separating the document from the strip and which can adopt at least one first configuration, in which it does not occupy said path, and at least one second configuration, in which it occupies said path;

a sensor means arranged for detecting a free path situation, when said cutting device is in said first configuration, and an occupied path situation, when said cutting device is in said second configuration;

a conveying device for moving back the strip that has just been separated from the document to a zone for the start of printing a new document;

a control means arranged for driving said conveying device to move back the strip in response to a signal emitted by said sensor means when said cutting device, after separating the document from the strip, is in said second configuration, so as to anticipate the driving of the conveying device before said cutting device returns to said first configuration to accelerate printing in series of several documents.

22. A printing apparatus comprising:

a printing device arranged for printing a document on a strip that advances along a path;

a cutting device which is arranged for separating the document from the strip and which can adopt at least one first configuration, in which it does not occupy said path, and at least one second configuration, in which it occupies said path;

a sensor means arranged for detecting a free path situation, when said cutting device is in said first configuration, and an occupied path situation, when said cutting device is in said second configuration;

an at least one advancement device arranged for sending the document separated from the strip to an outlet;

a control means arranged for driving said advancement device to send the document in response to a signal emitted by said sensor means when said cutting device, after separating the document from the strip, is in said second configuration, so as to anticipate the driving of the actuator before said cutting device returns to said first configuration to accelerate printing in series of several documents.

* * * * *